US012392070B2

(12) United States Patent
Seo et al.

(10) Patent No.: US 12,392,070 B2
(45) Date of Patent: Aug. 19, 2025

(54) SYSTEMS AND METHODS FOR DRAIN PUMP OPERATION IN WASHING MACHINE APPLIANCES

(71) Applicant: Haier US Appliance Solutions, Inc., Wilmington, DE (US)

(72) Inventors: Wonmyung Seo, Seongnam (KR); Taehyun Yoon, Gyeonggi (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 429 days.

(21) Appl. No.: 17/956,241

(22) Filed: Sep. 29, 2022

(65) Prior Publication Data

US 2024/0110321 A1 Apr. 4, 2024

(51) Int. Cl.
*D06F 33/42* (2020.01)
*D06F 23/04* (2006.01)
(Continued)

(52) U.S. Cl.
CPC ..... *D06F 33/42* (2020.02); *D06F 23/04* (2013.01); *D06F 34/06* (2020.02); *D06F 34/24* (2020.02);
(Continued)

(58) Field of Classification Search
CPC ..... D06F 33/42; D06F 23/04; D06F 34/06; D06F 34/24; D06F 39/085; D06F 39/087;
(Continued)

(56) References Cited

U.S. PATENT DOCUMENTS 5,230,227 A * 7/1993 Kondoh ..... D06F 34/22 706/900
5,444,531 A * 8/1995 Foreman ..... A47L 15/4297 68/12.27
(Continued)

FOREIGN PATENT DOCUMENTS

CN 107692944 A * 2/2018 ..... A47L 15/42
CN 108716083 A * 10/2018
(Continued)

*Primary Examiner* — Michael E Barr
*Assistant Examiner* — Thomas Bucci
(74) *Attorney, Agent, or Firm* — Dority & Manning, P.A.

(57) ABSTRACT

A controller is configured to monitor the pressure measurement of the pressure sensor and record an ambient temperature measurement in response to the pressure measurement stabilizing. Activate the pump and a timer in response to a drain cycle starting. The controller also configured to record a turbidity measurement from the turbidity sensor, a conductivity measurement from the conductivity sensor, and a temperature measurement from the temperature sensor and compare the turbidity measurement to a reference turbidity value, the conductivity measurement to a reference conductivity value, and the temperature measurement to the ambient temperature measurement. Then determine either a presence or an absence of fluid in the wash tub based at least in part on the turbidity measurement, the conductivity measurement, and the temperature measurement, and deactivate the pump in response to either the timer expiring or the determination of the absence of fluid in the wash tub.

18 Claims, 5 Drawing Sheets

300

| | In water (Water in tub) | In air (No water in tub) |
|---|---|---|
| Conductivity | 400 - 200 μS/cm | 0 μS/cm |
| Turbidity | 800 - 1100 NTU | 0 - 400 NTU Some water on the tip of the sensor has increased the readings |
| Temperature | 35 - 38C Mix with cold and hot | 20 - 23C |

(51) Int. Cl.

| | |
|---|---|
| ***D06F 34/06*** | (2020.01) |
| ***D06F 34/24*** | (2020.01) |
| ***D06F 39/08*** | (2006.01) |
| ***D06F 103/20*** | (2020.01) |
| *D06F 103/16* | (2020.01) |
| *D06F 103/18* | (2020.01) |
| *D06F 105/08* | (2020.01) |
| *D06F 105/56* | (2020.01) |

(52) U.S. Cl.
CPC ..... *D06F 39/085* (2013.01); *D06F 39/087* (2013.01); *D06F 2103/16* (2020.02); *D06F 2103/18* (2020.02); *D06F 2103/20* (2020.02); *D06F 2105/08* (2020.02); *D06F 2105/56* (2020.02)

(58) Field of Classification Search
CPC ..... D06F 2103/16; D06F 2103/18; D06F 2103/20; D06F 2105/08; D06F 2105/56; D06F 2103/38; D06F 34/22
USPC ..... 68/12.01
See application file for complete search history.

(56) References Cited

U.S. PATENT DOCUMENTS

| | | | | | |
|---|---|---|---|---|---|
| 5,446,531 | A * | 8/1995 | Boyer | A47L 15/4287 | 68/12.02 |
| 5,560,060 | A * | 10/1996 | Dausch | A47L 15/0044 | 68/12.22 |
| 5,729,025 | A * | 3/1998 | Erickson | D06F 34/22 | 68/12.02 |
| 5,957,144 | A * | 9/1999 | Neff | A47L 15/46 | 134/113 |
| 8,506,725 | B2 * | 8/2013 | Bragg | B08B 3/00 | 134/56 D |
| 2003/0213503 | A1 * | 11/2003 | Price | C11D 3/3953 | 134/40 |
| 2007/0039357 | A1 * | 2/2007 | Grimm | G01N 13/02 | 68/17 R |
| 2008/0141465 | A1 * | 6/2008 | Muenzner | D06F 39/087 | 8/158 |
| 2009/0140754 | A1 * | 6/2009 | Schenkl | D06F 34/22 | 324/693 |
| 2013/0145563 | A1 * | 6/2013 | Kang | D06F 33/38 | 68/12.02 |
| 2018/0002856 | A1 * | 1/2018 | Hombroek | D06F 39/087 | |
| 2018/0002859 | A1 * | 1/2018 | Hombroek | D06F 39/087 | |
| 2018/0084966 | A1 * | 3/2018 | Thiyagarajan | A47L 15/0023 | |
| 2019/0159652 | A1 * | 5/2019 | Durham | A47L 15/23 | |
| 2020/0141040 | A1 * | 5/2020 | Cha | D06F 34/24 | |
| 2021/0198834 | A1 * | 7/2021 | Hammond | D06F 25/00 | |
| 2022/0104684 | A1 * | 4/2022 | Ross | A47L 15/08 | |
| 2022/0154378 | A1 * | 5/2022 | Zattin | D06F 35/005 | |
| 2022/0162790 | A1 * | 5/2022 | Zattin | D06F 33/36 | |
| 2022/0195650 | A1 * | 6/2022 | Hombroek | D06F 34/18 | |

FOREIGN PATENT DOCUMENTS

| | | | | |
|---|---|---|---|---|
| CN | 112593380 | A * | 4/2021 | D06F 33/47 |
| CN | 112593380 | B | 10/2021 | |
| EP | 2505709 | A1 * | 10/2012 | D06F 39/087 |
| EP | 3290571 | A1 * | 3/2018 | A47L 15/42 |
| EP | 3712317 | A1 * | 9/2020 | A47L 15/4297 |
| GB | 2068419 | A * | 8/1981 | D06F 39/004 |
| JP | 2013103053 | A * | 5/2013 | |

* cited by examiner

300

| | In water (Water in tub) | In air (No water in tub) |
|---|---|---|
| Conductivity | 400 - 200 μS/cm | 0 μS/cm |
| Turbidity | 800 - 1100 NTU | 0 - 400 NTU Some water on the tip of the sensor has increased the readings |
| Temperature | 35 - 38C Mix with cold and hot | 20 - 23C |

FIG. 3

SYSTEMS AND METHODS FOR DRAIN PUMP OPERATION IN WASHING MACHINE APPLIANCES

FIELD OF THE INVENTION

The present subject matter relates generally to operation of a drain pump in washing machine appliances.

BACKGROUND OF THE INVENTION

Washing machine appliances generally include a wash tub for containing water or wash fluid (e.g., water, detergent, bleach, or other wash additives). A basket is rotatably mounted within the wash tub and defines a wash chamber for receipt of articles for washing. During normal operation of such washing machine appliances, the wash fluid is directed into the wash tub and onto articles within the wash chamber of the basket. The basket or an agitation element can rotate at various speeds to agitate articles within the wash chamber, to wring wash fluid from articles within the wash chamber, etc.

Washing machine appliances can operate in numerous cycles. For example, the typical washing machine appliance may be operable in various wash cycles, rinse cycles, drain cycles, and spin cycles. In the wash cycle, the wash fluid is directed into the wash tub and onto articles within the wash chamber of the basket. The rinse cycle includes rinsing the articles in the wash tub, e.g., with fresh water. The drain cycle is used in between different cycles to drain the wash fluid out of the wash tub. In each of the cycles, fluid may be present in the tub of the washing machine appliance, and proper operation of the washing machine may rely upon knowing how much fluid, if any, is in the tub.

BRIEF DESCRIPTION OF THE INVENTION

Aspects and advantages of the invention will be set forth in part in the following description, or may be apparent from the description, or may be learned through practice of the invention.

In one example embodiment, a washing machine appliance includes a cabinet, a wash tub positioned within the cabinet, and a wash basket rotatably mounted within the wash tub. The wash basket is accessible through an opening in the cabinet. A pump is configured to remove fluid from the wash tub, and a pressure sensor is disposed at the wash tub. A turbidity sensor, a conductivity sensor, and a temperature sensor are disposed in the cabinet, and a controller is in signal communication with the pressure sensor, the turbidity sensor, the conductivity sensor and the temperature sensor. The controller is configured to monitor the pressure measurement of the pressure sensor and record an ambient temperature measurement in response to the pressure measurement stabilizing. Activate the pump and a timer in response to a drain cycle starting. The controller is also configured to record a turbidity measurement from the turbidity sensor, a conductivity measurement from the conductivity sensor, and a temperature measurement from the temperature sensor and compare the turbidity measurement to a reference turbidity value, the conductivity measurement to a reference conductivity value, and the temperature measurement to the ambient temperature measurement. Then determine either a presence or an absence of fluid in the wash tub based at least in part on the turbidity measurement, the conductivity measurement, and the temperature measurement, and deactivate the pump in response to either the timer expiring or the determination of the absence of fluid in the wash tub.

In another example embodiment, a method of operating a washing machine appliance. The washing machine appliance includes a cabinet, a wash tub positioned within the cabinet, and a wash basket rotatably mounted within the wash tub. The wash basket is accessible through an opening in the cabinet. A pump is configured to remove fluid from the wash tub, and a pressure sensor is disposed at the wash tub. A turbidity sensor, a conductivity sensor, and a temperature sensor are disposed in the cabinet, and a controller is in signal communication with the pressure sensor, the turbidity sensor, the conductivity sensor and the temperature sensor. The method includes monitoring, by the controller, the pressure measurement of the pressure sensor and recording, at the controller, an ambient temperature measurement in response to the pressure measurement stabilizing. Then activating, by the controller, the pump and a timer in response to a drain cycle starting, and recording, at the controller, a turbidity measurement from the turbidity sensor, a conductivity measurement from the conductivity sensor, and a temperature measurement from the temperature sensor. Then comparing, by the controller, the turbidity measurement to a reference turbidity value, the conductivity measurement to a reference conductivity value, and the temperature measurement to the ambient temperature measurement, and determining, by the controller, either a presence or an absence of fluid in the wash tub based at least in part on the turbidity measurement, the conductivity measurement, and the temperature measurement. Then, deactivating, by the controller, the pump in response to either the timer expiring or the determination of the absence of fluid in the wash tub.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 3 provides an example table of values stored on a controller of the example washing machine appliance of FIG. 1.

Figure 1:
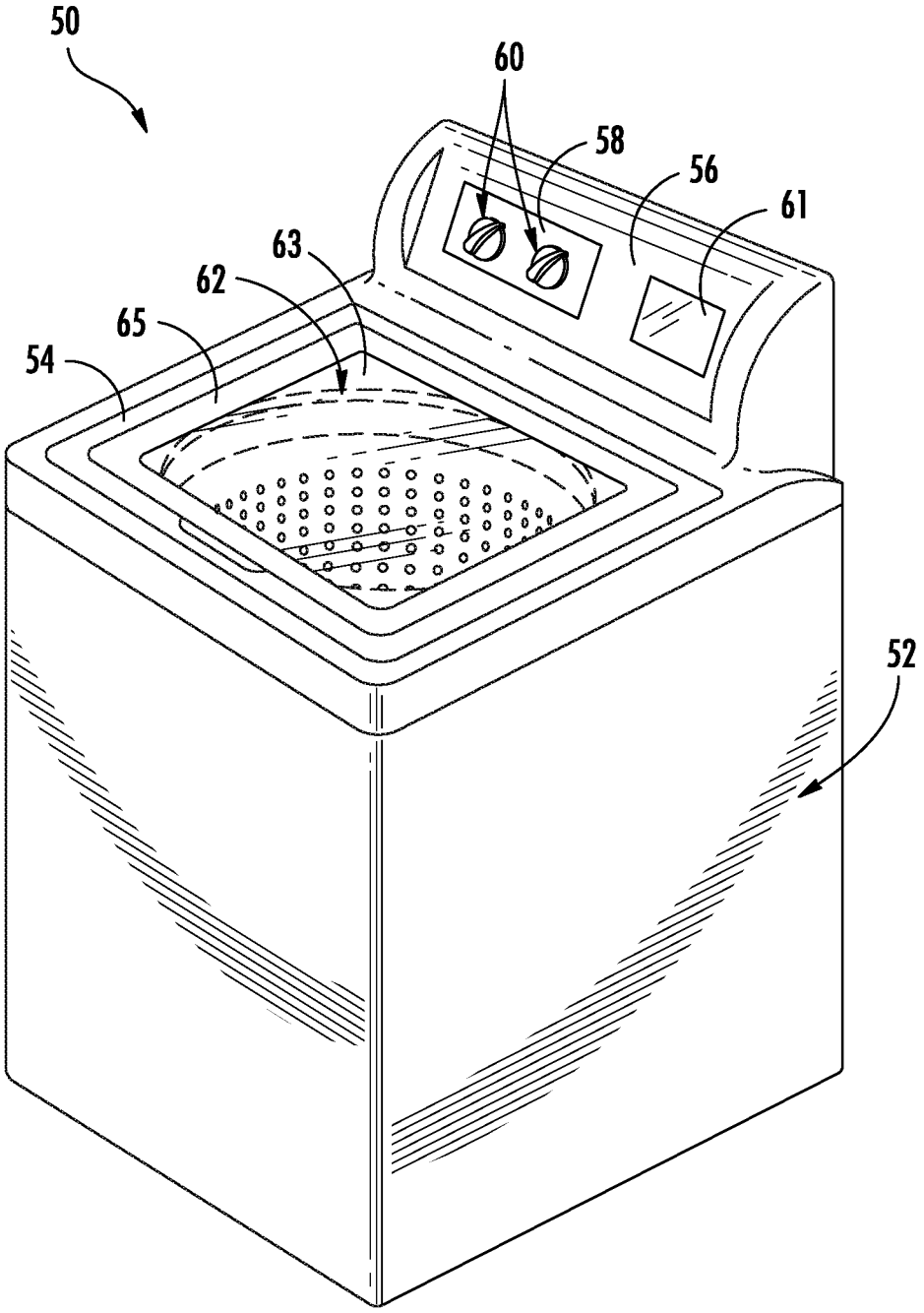
FIG. 1 provides a perspective view of a washing machine appliance according to example embodiments of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The phrase "in one embodiment," does not necessarily refer to the same embodiment, although it may. The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
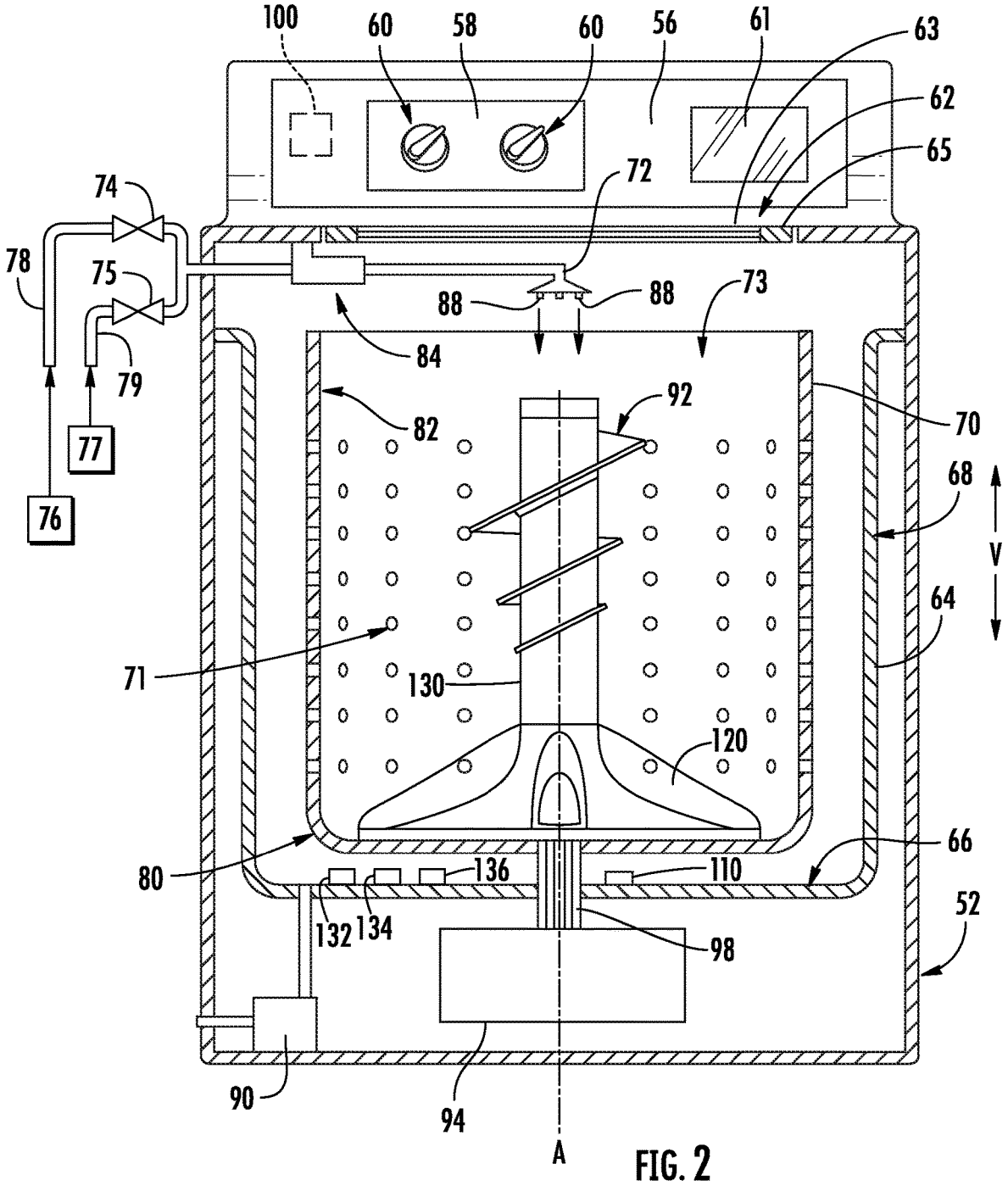
FIG. 2 provides a sectional elevation view of the example washing machine appliance of FIG. 1.

Turning now to the figures, FIGS. 1 and 2 provide separate views of a washing machine appliance 50 according to example embodiments of the present disclosure. As shown, washing machine appliance 50 generally defines a vertical direction V, a lateral direction L, and a transverse direction T. The vertical direction V, lateral direction L, and transverse direction T are each mutually perpendicular and form an orthogonal direction system. Washing machine appliance 50 may include a cabinet 52 and a cover 54. A backsplash 56 extends from cover 54, and a control panel 58, including a plurality of input selectors 60, is coupled to backsplash 56.

Control panel 58 and input selectors 60 collectively form a user interface input for operator selection of machine cycles and features, and in one example embodiment, a display 61 indicates selected features, a countdown timer, or other items of interest to machine users. It should be appreciated, however, that in other example embodiments, the control panel 58, input selectors 60, and display 61, may have any other suitable configuration. For example, in other example embodiments, one or more of the input selectors 60 may be configured as manual "push-button" input selectors, or alternatively may be configured as a touchscreen (e.g., on display 61).

A 7 62 may be mounted to cover 54 and rotatable between an open position (not shown) facilitating access to a tub, also referred to as a wash tub, 64 located within cabinet 52 and a closed position (FIG. 1) forming an enclosure over tub 64. Lid 62 in example embodiment includes a transparent panel 63, which may be formed of, for example, glass, plastic, or any other suitable material. The transparency of the panel 63 allows users to see through the panel 63, and into the tub 64 when the lid 62 is in the closed position. In some example embodiments, the panel 63 itself can generally form the lid 62. In other example embodiments, the lid 62 includes the panel 63 and a frame 65 surrounding and encasing the panel 63. Alternatively, panel 63 need not be transparent.

As may be seen in FIG. 2, tub 64 includes a bottom wall 66 and a sidewall 68. A wash drum or basket 70 is rotatably mounted within tub 64. In particular, basket 70 is rotatable about a central axis, which may when properly balanced and positioned in the example embodiment illustrated be a vertical axis. Thus, washing machine appliance is generally referred to as a vertical axis washing machine appliance or a top load washing machine appliance. Basket 70 defines a wash chamber 73 for receipt of articles for washing and extends, for example, vertically, between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent to top portion 82 of basket 70. Nozzle 72 may be in fluid communication with one or more water sources 76, 77 in order to direct liquid (e.g., water) into tub 64 or onto articles within chamber 73 of basket 70. Nozzle 72 may further include apertures 88 through which water may be sprayed into the tub 64. Apertures 88 may, for example, be tubes extending from the nozzles 72 as illustrated, or simply holes defined in the nozzles 72 or any other suitable openings through which water may be sprayed. Nozzle 72 may additionally include other openings, holes, etc. (not shown) through which water may be flowed (i.e., sprayed or poured) into the tub 64.

Various valves may regulate the flow of fluid through nozzle 72. For example, a flow regulator may be provided to control a flow of hot or cold water into the wash chamber of washing machine appliance 50. For the example embodiment depicted, the flow regulator includes a hot water valve 74 and a cold water valve 75. The hot and cold water valves 74, 75 are used to flow hot water and cold water, respectively, therethrough. Each valve 74, 75 can selectively adjust to a closed position in order to terminate or obstruct the flow of fluid therethrough to nozzle 72. The hot water valve 74 may be in fluid communication with a hot water source 76, which may be external to the washing machine appliance 50. The cold water valve 75 may be in fluid communication with a cold water source 77, which may be external to the washing machine appliance 50. The cold water source 77 may, for example, be a commercial water supply, while the hot water source 76 may be, for example, a water heater. Such water sources 76, 77 may supply water to the appliance 50 through the respective valves 74, 75. A hot water conduit 78 and a cold water conduit 79 may supply hot and cold water, respectively, from the sources 76, 77 through the respective valves 74, 75 and to the nozzle 72.

An additive dispenser 84 may additionally be provided for directing a wash additive, such as detergent, bleach, liquid fabric softener, etc., into the tub 64. For example, dispenser 84 may be in fluid communication with nozzle 72 such that water flowing through nozzle 72 flows through dispenser 84, mixing with wash additive at a desired time during operation to form a liquid or wash fluid, before being flowed into tub 64. For the example embodiment depicted, nozzle 72 is a separate downstream component from dispenser 84. In other example embodiments, however, nozzle 72 and dispenser 84 may be integral, with a portion of dispenser 84 serving as the nozzle 72, or alternatively dispenser 84 may be in fluid communication with only one of hot water valve 74 or cold water valve 75. In still other example embodiments, the washing machine appliance 50 may not include a dispenser, in which case a user may add one or more wash additives directly to wash chamber 73. A pump assembly 90 (shown schematically in FIG. 2) is located beneath tub 64 and basket 70 for gravity assisted flow to drain tub 64.

An agitation element 92 may be oriented to rotate about the rotation axis A (e.g., parallel to the vertical direction V). Generally, agitation element 92 includes an impeller base 120 and extended post 130. The agitation element 92 depicted is positioned within the basket 70 to impart motion to the articles and liquid in the chamber 73 of the basket 70. More particularly, the agitation element 92 depicted is provided to impart downward motion of the articles along the rotation axis A. For example, with such a configuration, during operation of the agitation element 92 the articles may be moved downwardly along the rotation axis A at a center of the basket 70, outwardly from the center of basket 70 at the bottom portion 80 of the basket 70, then upwardly along the rotation axis A towards the top portion 82 of the basket 70.

In optional example embodiments, basket 70 and agitation element 92 are both driven by a motor 94. Motor 94 may, for example, be a pancake motor, direct drive brushless motor, induction motor, or other motor suitable for driving basket 70 and agitation element 92. As motor output shaft 98 is rotated, basket 70 and agitation element 92 are operated for rotatable movement within tub 64 (e.g., about rotation axis A). Washing machine appliance 50 may also include a brake assembly (not shown) selectively applied or released for respectively maintaining basket 70 in a stationary position within tub 64 or for allowing basket 70 to spin within tub 64.

Various sensors may additionally be included in the washing machine appliance 50. For example, a pressure sensor 110 may be positioned in the tub 64 as illustrated or, alternatively, may be remotely mounted in another location within the appliance 50 and be operationally connected to tub 64 by a hose (not shown). Any suitable pressure sensor 110, such as an electronic sensor, a manometer, or another suitable gauge or sensor, may be used. The pressure sensor 110 may generally measure the pressure of water in the tub 64. This pressure can then be used to estimate the height or amount of water in the tub 64. Pump 90 may be configured to operate in response to pressure sensor 101 measuring a water level exceeding a limit value, e.g., a maximum fill value. In other words, controller 100 may be configured to operate pump 90 to remove fluid from tub 64. Additionally, a suitable speed sensor can be connected to the motor 94, such as to the output shaft 98 thereof, to measure speed and indicate operation of the motor 94. Other suitable sensors, such as temperature sensors, water sensors, moisture sensors, etc., may additionally be provided in the washing machine appliance 50.

Operation of washing machine appliance 50 is controlled by a processing device or controller 100, that is operatively coupled to the input selectors 60 located on washing machine backsplash 56 for user manipulation to select washing machine cycles and features. Controller 100 may further be operatively coupled to various other components of appliance 50, such as the flow regulator (including valves 74, 75), motor 94, pressure sensor 110, other suitable sensors, etc. In response to user manipulation of the input selectors 60, controller 100 may operate the various components of washing machine appliance 50 to execute selected machine cycles and features.

While described in the context of specific example embodiments of washing machine appliance 50, using the teachings disclosed herein it will be understood that washing machine appliance 50 is provided by way of example only. Other washing machine appliances having different configurations, different appearances, or different features may also be used with the present subject matter as well.

In addition to pressure sensor 110, washing machine appliance 50 may include various other sensors, e.g., a turbidity sensor 132, a conductivity sensor 134, and a temperature sensor 136. Each of turbidity sensor 132, conductivity sensor 134, and temperature sensor 136 may be configured for signal communication with controller 100, e.g., sending measurement data or signals to controller 100. In some example embodiments, turbidity sensor 132, conductivity sensor 134, and temperature sensor 136 may be combined in any combination to reduce to the total number of sensors in washing machine appliance 50. Further, turbidity sensor 132, conductivity sensor 134, and temperature sensor 136 may be positioned in tub 64, e.g., on a bottom wall 66 of tub 64.

Controller 100 of washing machine appliance 50 may be configured to monitor, e.g., continuously, a pressure measurement of pressure sensor 110. The pressure measurement may be indicative of the height of the fluid in tub 64. Pressure sensor 110 may read values continuously, e.g., the values incrementally increase as the height of the fluid within tub 64 increases. Before filling tub 64 with fluid, controller 100 may record an ambient temperature measurement in response to the pressure measurement stabilizing, e.g., before washing machine appliance 50 begins operating, the ambient temperature measurement may be recorded. During a drain cycle of washing machine appliance 50, controller 100 may be configured to record a turbidity measurement from turbidity sensor 132, a conductivity measurement from conductivity sensor 134, and a temperature measurement from temperature sensor 136. These turbidity, conductivity, and temperature measurements may be recorded in response to the pressure measurement further incrementing, e.g., the pressure measurement may be incrementally increasing when the pressure measurement is not expected to incrementally increase.

When the various measurements are recorded, controller 100 may be configured to compare the turbidity measurement to a reference turbidity value, the conductivity measurement to a reference conductivity value, and the temperature measurement to the ambient temperature measurement. As seen in table 300 of FIG. 3, when fluid is present in tub 64, turbidity sensor 132 may record a turbidity measurement between eight-hundred and one-thousand one-hundred Nephelometric Turbidity units (800 NTU-1100 NTU), conductivity sensor 134 may record a conductivity measurement between four hundred and two hundred micro-Siemens per centimeter (400 μS/cm-200 μS/cm), and temperature sensor 136 may record a temperature measurement between thirty-five degrees Celsius and thirty-eight degrees Celsius (35° C.-38° C.). When fluid is not present in tub 64, turbidity sensor 132 may record a turbidity measurement between zero and four hundred Nephelometric Turbidity units (0 NTU-400 NTU), conductivity sensor 134 may record a conductivity measurement of zero μS/cm (0 μS/cm), and temperature sensor 136 may record a temperature measurement between twenty degrees Celsius and twenty-three degrees Celsius (20° C.-23° C.).

With table 300 of FIG. 3 stored in the memory of controller 100, controller 100 may determine a presence of fluid in tub 64 via the values of the turbidity measurement, the conductivity measurement, and the temperature measurement. In the situation where the pressure measurement is incrementally increasing and it is determined that there is no fluid in tub 64, controller 100 may terminate operation of washing machine appliance 50, because pressure sensor may be broken. For example, following the drain cycle of washing machine appliance 50, there may be no water in tub 64, but pressure sensor 110 may still be incrementing the pressure measurement. The turbidity measurement, conductivity measurement, and temperature measurement may verify the presence, or absence, of water in tub 64. In response to no water being in tub 64, controller 100 may then terminate the operation of washing machine appliance 50. The extraneous incrementation of the pressure measurement may be indicative of failure of pressure sensor 110. Thus, controller 100 may be configured to notify a user that the pressure sensor 110 may have failed and may not be working properly.

Figure 4:
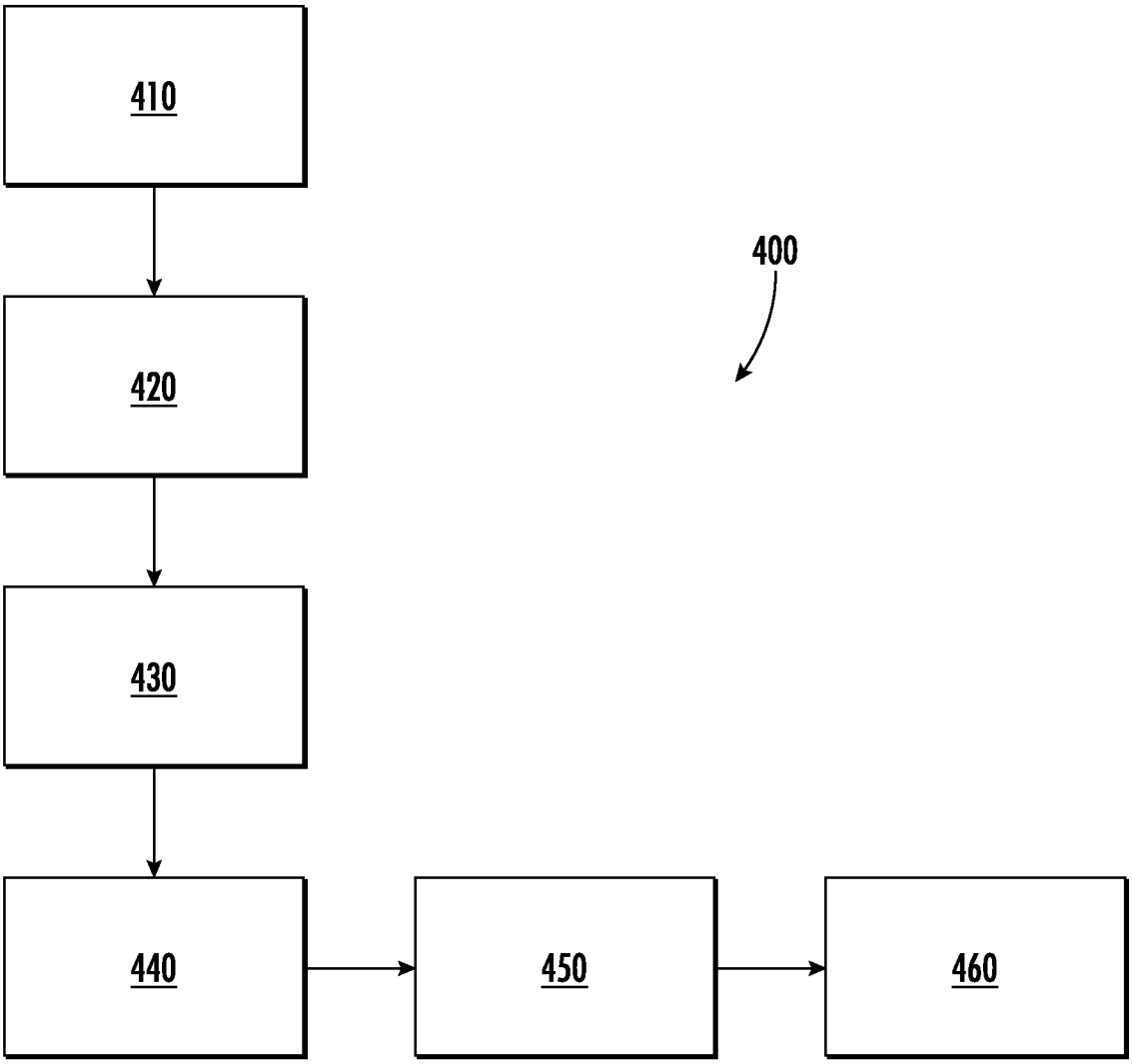
FIG. 4 provides an example method of operating the example washing machine appliance of FIG. 1.

Shown in FIG. 4, method 400 provides a method of operating washing machine appliance 50. At 410, controller 100 of washing machine appliance 50 may continuously monitor the pressure measurement of pressure sensor 110. The pressure measurement may be indicative of the height of the fluid in tub 64. Pressure sensor 110 may read values continuously, e.g., the values incrementally increase as the height of the fluid within tub 64 increases. Before filling tub 64 with fluid, at 420 controller 100 may record an ambient temperature measurement in response to the pressure measurement stabilizing, e.g., before washing machine appliance 50 begins operating, the ambient temperature measurement may be recorded. During the drain cycle of washing machine appliance 50, e.g., at 430, controller 100 may record a turbidity measurement from turbidity sensor 132, a conductivity measurement from conductivity sensor 134, and a temperature measurement from temperature sensor 136. These measurements may be recorded in response to the pressure measurement further incrementing, e.g., the pressure measurement may be incrementally increasing when the pressure measurement is not expected to increase.

When the various measurements are recorded, controller 100 may, at 440, compare the turbidity measurement to a reference turbidity value, the conductivity measurement to a reference conductivity value, and the temperature measurement to the ambient temperature measurement. Thus at 460, controller 100 may determine the presence of fluid in tub 64 via the values of the turbidity measurement, the conductivity measurement, and the temperature measurement. As stated above, table 300 of FIG. 3 may be stored in the memory of controller 100 and provides the reference values for the turbidity measurement, the conductivity measurement, and the temperature measurement with respect to the presence of fluid in tub 64.

Referring again to FIGS. 1-3, washing machine appliance 50 may be configured to operate pump 90 to drain fluid from tub 64, e.g., during the drain cycle. The drain cycle may include a timer during which pump 90 operates. The length of time of the timer may be determined by an algorithm that includes fill height (FHt), time (T), and constant values such as a buffer time constant (BC), a time to reach coefficient (TC), and a fill height coefficient (FC). Thus, the algorithm may be:

$$\text{Length of Timer}=BC+(TC*T)+(FC*FHt)$$

The algorithm described above is provided by way of example only and may include more or less variables in other example embodiments. In addition to the timer, pump 90 may also be deactivated in response to the determination that there is no fluid in tub 64 for a set length of time via turbidity sensor 132, conductivity sensor 134, and temperature sensor 136. The set length of time of determining no fluid in tub 64 may be at least five seconds.

Figure 5:
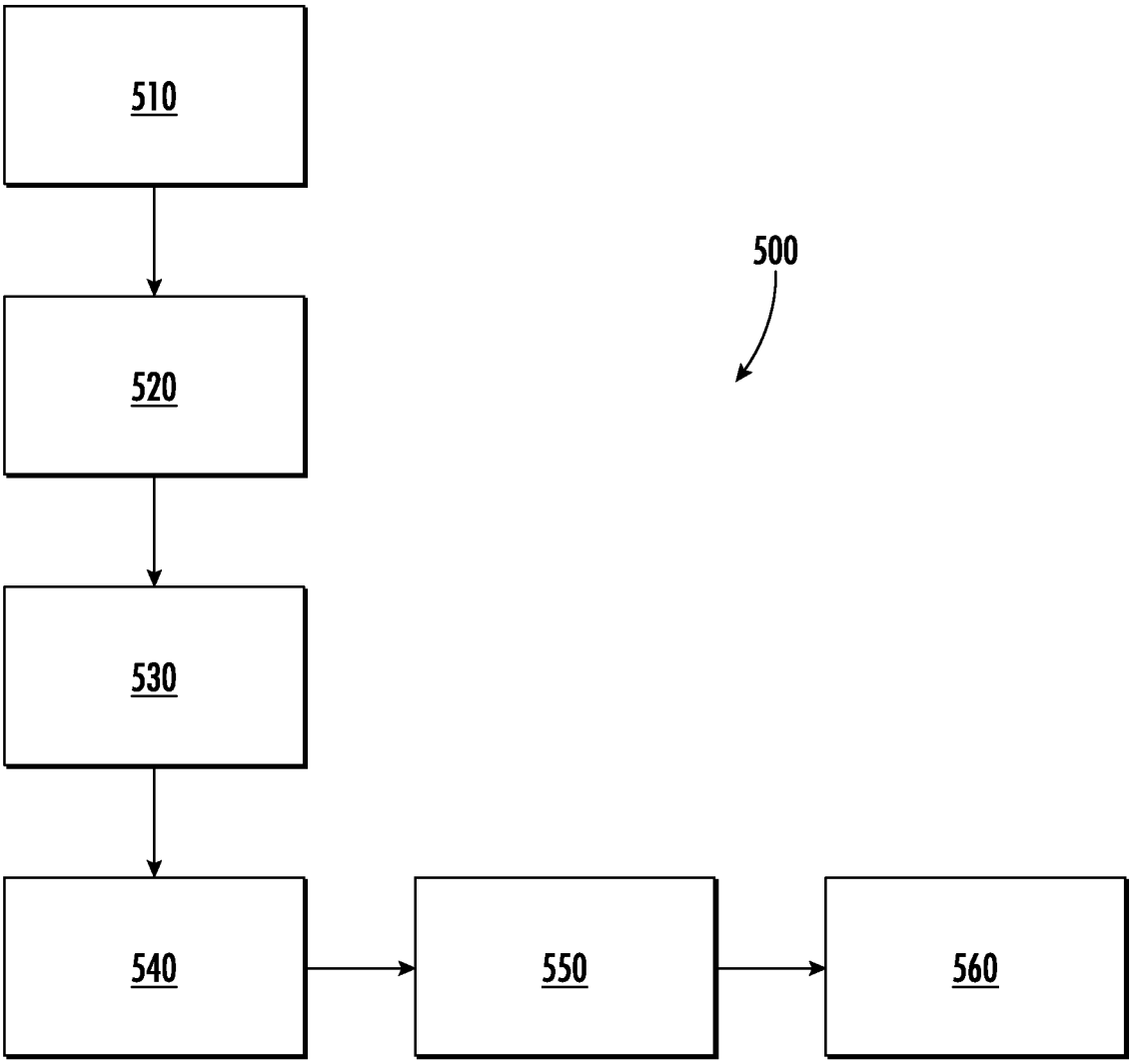
FIG. 5 provides an example method of operating the example washing machine appliance of FIG. 1.

Shown in FIG. 5, method 500 provides a method of operating washing machine appliance 50. At 510, controller 100 may monitor the pressure measurement of the pressure sensor. Then at 520, controller 100 may record an ambient temperature measurement in response to the pressure measurement stabilizing. At 530 controller 100 may activate pump 90 and the timer to start the drain cycle. At 540, controller 100 may record a turbidity measurement from turbidity sensor 132, a conductivity measurement from conductivity sensor 134, and a temperature measurement from temperature sensor 136. Then at 550, controller 100 may compare the turbidity measurement to a reference turbidity value, the conductivity measurement to a reference conductivity value, and the temperature measurement to the ambient temperature measurement. Based on the comparison, at 560 controller 100 may determine one of a presence or an absence of fluid in tub 64. Based on the determination, at 570 controller 100 may deactivate pump 90 in response to either the timer expiring or the determination of the absence of fluid in tub 64.

FIGS. 4 and 5 depict steps performed in a particular order for purposes of illustration and discussion. Those of ordinary skill in the art, using the disclosures provided herein, will understand that the steps of any of the methods discussed herein may be adapted, rearranged, expanded, omitted, or modified in various ways without deviating from the scope of the present disclosure. Moreover, although aspects of method 400 and method 500 are explained using washing machine appliance 50 as an example, it should be appreciated that these methods may be applied to the operation of any suitable appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a cabinet;

a wash tub positioned within the cabinet;

a wash basket rotatably mounted within the wash tub and accessible through an opening in the cabinet;

a pump configured to remove fluid from the wash tub;

a pressure sensor disposed at the wash tub;

a turbidity sensor, a conductivity sensor and a temperature sensor disposed in the cabinet;

a controller in signal communication with the pump, the pressure sensor, the turbidity sensor, the conductivity sensor, and the temperature sensor, the controller configured to monitor a pressure measurement of the pressure sensor while the wash tub fills with water, record an ambient temperature measurement from the temperature sensor in response to the monitored pressure measurement stabilizing, wherein the wash tub is filled with water, activate the pump and a timer in response to a drain cycle starting, record a turbidity measurement from the turbidity sensor, a conductivity measurement from the conductivity sensor, and a temperature measurement from the temperature sensor, compare the turbidity measurement to a reference turbidity value, the conductivity measurement to a reference conductivity value, and the temperature measurement to the ambient temperature measurement, determine either a presence or an absence of fluid in the wash tub based at least in part on the turbidity measurement, the conductivity measurement, and the temperature measurement, and deactivate the pump in response to either the timer expiring or the determination of the absence of fluid in the wash tub.

2. The washing machine appliance of claim 1, wherein the controller is configured to operate the pump in response to the pressure measurement exceeding a limit value.

3. The washing machine appliance of claim 1, wherein the reference turbidity value and the reference conductivity value are values stored in a memory of the controller.

4. The washing machine appliance of claim 1, wherein each of the turbidity sensor, the conductivity sensor, and the temperature sensor are disposed at a bottom portion of the wash tub.

5. The washing machine appliance of claim 1, wherein the washing machine is a top load washing machine appliance.

6. The washing machine appliance of claim 1, wherein the turbidity sensor, the conductivity sensor, and the temperature sensor are combined within a single sensor assembly.

7. The washing machine appliance of claim 1, wherein a length of the timer is calculated by an algorithm that comprises a plurality of constant values that are each a respective factor of a fill height measured by the pressure sensor and elapsed time.

8. The washing machine appliance of claim 1, wherein the controller is configured to determine the absence of fluid in the wash tub in response to the turbidity measurement being less than the reference turbidity value, the conductivity measurement being less than the reference conductivity value, and the temperature measurement being different than the ambient temperature measurement for a set length of time.

9. The washing machine appliance of claim 8, wherein the set length of time is no less than five seconds.

10. A method of operating a washing machine appliance, the washing machine appliance comprising a cabinet, a wash tub positioned within the cabinet, a wash basket rotatably mounted within the wash tub and accessible through an opening in the cabinet, a pump configured to remove fluid from the wash tub, a pressure sensor disposed at the wash tub, the pressure sensor configured to continuously record a pressure measurement, a turbidity sensor, a conductivity sensor, and a temperature sensor disposed in the cabinet, a controller in signal communication with the pressure sensor, the turbidity sensor, the conductivity sensor and the temperature sensor, the method comprising:

monitoring, by the controller, the pressure measurement of the pressure sensor while the wash tub fills with water, recording, at the controller, an ambient temperature measurement from the temperature sensor in response to the pressure measurement stabilizing, wherein the wash tub is filled with water, activating, by the controller, the pump and a timer in response to a drain cycle starting, recording, at the controller, a turbidity measurement from the turbidity sensor, a conductivity measurement from the conductivity sensor, and a temperature measurement from the temperature sensor, comparing, by the controller, the turbidity measurement to a reference turbidity value, the conductivity measurement to a reference conductivity value, and the temperature measurement to the ambient temperature measurement, determining, by the controller, either a presence or an absence of fluid in the wash tub based at least in part on the turbidity measurement, the conductivity measurement, and the temperature measurement, and deactivating, by the controller, the pump in response to either the timer expiring or the determination of the absence of fluid in the wash tub.

11. The method of claim 10, further comprising operating, by the controller, the pump in response to the pressure sensor measurement exceeding a limit value.

12. The method of claim 10, wherein the reference turbidity value and the reference conductivity value are values stored in a memory of the controller.

13. The method of claim 10, wherein each of the turbidity sensor, the conductivity sensor and the temperature sensor are disposed at bottom portion of the wash tub.

14. The method of claim 10, wherein the washing machine is a top load washing machine appliance.

15. The method of claim 10, wherein the turbidity sensor, the conductivity sensor, and the temperature sensor are combined within a single sensor assembly.

16. The method of claim 10, wherein a length of the timer is calculated by an algorithm that comprises a plurality of constant values that are each a respective factor of a fill height measured by the pressure sensor and elapsed time.

17. The method of claim 10, wherein the controller is configured to determine the absence of fluid in the wash tub in response to the turbidity measurement being less than the reference turbidity value, the conductivity measurement being less than the reference conductivity value, and the temperature measurement being different than the ambient temperature measurement for a set length of time.

18. The method of claim 17, wherein the set length of time is no less than five seconds.

* * * * *